US010101096B2

(12) United States Patent
Honma et al.

(10) Patent No.: US 10,101,096 B2
(45) Date of Patent: Oct. 16, 2018

(54) HEAT EXCHANGER

(71) Applicant: DENSO CORPORATION, Kariya, Aichi-pref. (JP)

(72) Inventors: Nobuhiro Honma, Kariya (JP); Manabu Hasegawa, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 220 days.

(21) Appl. No.: 14/415,175

(22) PCT Filed: Jul. 17, 2013

(86) PCT No.: PCT/JP2013/004348

§ 371 (c)(1),
(2) Date: Jan. 16, 2015

(87) PCT Pub. No.: WO2014/013725

PCT Pub. Date: Jan. 23, 2014

(65) Prior Publication Data

US 2015/0168080 A1 Jun. 18, 2015

(30) Foreign Application Priority Data

Jul. 18, 2012 (JP) ..... 2012-159496

(51) Int. Cl.
*F28F 9/26* (2006.01)
*F28F 1/04* (2006.01)
(Continued)

(52) U.S. Cl.
CPC ..... *F28F 1/045* (2013.01); *F28F 9/0224* (2013.01); *F28F 9/182* (2013.01); *F28F 9/26* (2013.01);
(Continued)

(58) Field of Classification Search
CPC .. F28F 9/0224; F28F 9/182; F28F 9/26; F28F 2225/08; F28F 1/00; F28F 9/0219; F28F 9/0226; F28F 2265/14; F28F 2265/26
See application file for complete search history.

(56) References Cited

U.S. PATENT DOCUMENTS 4,582,127 A * 4/1986 Moranne ..... F28F 9/0226 165/173
4,881,594 A * 11/1989 Beamer ..... F28F 9/0226 165/173
(Continued)

FOREIGN PATENT DOCUMENTS

JP H06142973 A 5/1994
JP H10160385 A 6/1998
(Continued)

OTHER PUBLICATIONS

International Search Report and Written Opinion (in Japanese with English Translation) for PCT/JP2013/004348, dated Oct. 29, 2013; ISA/JP.
(Continued)

*Primary Examiner* — Frantz Jules
*Assistant Examiner* — Lionel Nouketcha
(74) *Attorney, Agent, or Firm* — Harness, Dickey & Pierce, P.L.C.

(57) ABSTRACT

Provided is heat exchanger in which a rib of a core plate has a shape that is recessed from a flat surface of a flat body portion, and the rib is provided with: a rib bottom part including a bottom line that is recessed from and parallel to the flat surface of the flat body portion; and a rib inclination part that is positioned between the rib bottom part and a flat part. The rib is positioned so that the rib inclination part overlaps, in the tube stacking direction, the edge of the tube in the tube width direction.

16 Claims, 8 Drawing Sheets

(51) Int. Cl.

| | |
|---|---|
| ***F28F 9/18*** | (2006.01) |
| *F28F 9/02* | (2006.01) |
| *F28F 1/00* | (2006.01) |
| *F28D 1/053* | (2006.01) |
| *F28D 21/00* | (2006.01) |

(52) U.S. Cl.
CPC .. *F28D 1/05366* (2013.01); *F28D 2021/0094* (2013.01); *F28F 1/00* (2013.01); *F28F 9/0219* (2013.01); *F28F 2225/08* (2013.01); *F28F 2265/14* (2013.01); *F28F 2265/26* (2013.01)

(56) References Cited

U.S. PATENT DOCUMENTS

| | | | | |
|---|---|---|---|---|
| 5,797,448 | A | 8/1998 | Hughes et al. | |
| 5,816,316 | A * | 10/1998 | Hoffnung | F28F 9/0224 165/173 |
| 6,082,439 | A | 7/2000 | Kato et al. | |
| 7,426,958 | B2 * | 9/2008 | Yu | F28F 9/182 165/173 |
| 2005/0039900 | A1 | 2/2005 | Yu | |
| 2006/0144579 | A1 * | 7/2006 | Ozaki | F28D 1/05366 165/173 |
| 2008/0000626 | A1 * | 1/2008 | Sugito | F28D 1/05366 165/173 |
| 2009/0294111 | A1 * | 12/2009 | Larouche | F28D 1/05366 165/173 |

FOREIGN PATENT DOCUMENTS

| | | |
|---|---|---|
| JP | 2005061826 A | 3/2005 |
| JP | 2008032384 A | 2/2008 |

OTHER PUBLICATIONS

Office Action dated Feb. 16, 2016 in corresponding Chinese Application No. 201380037757.1 with English translation.

* cited by examiner

HEAT EXCHANGER

CROSS REFERENCE TO RELATED APPLICATIONS

This application is a U.S. National Phase Application under 35 U.S.C. 371 of International Application No. PCT/JP2013/004348 filed on Jul. 17, 2013 and published in Japanese as WO 2014/013725 A1 on Jan. 23, 2014. This application is based on and claims the benefit of priority from Japanese Patent Application No. 2012-159496 filed on Jul. 18, 2012. The entire disclosures of all of the above applications are incorporated herein by reference.

TECHNICAL FIELD

The present disclosure relates to a heat exchanger.

BACKGROUND ART

A conventional heat exchanger includes a core portion in which tubes and corrugated fins are stacked alternately. A tank is disposed on an end part of the tubes in a tube longitudinal direction. The tank includes a core plate to which the tubes are inserted, and a tank body portion fixed to the core plate to define an inner space of the tank together with the core plate.

The core plate includes: a flat body portion having a flat surface on an inner side of the tank, and tube holes through which the tubes are inserted; and a groove portion provided on an outer edge of the flat body portion. An end part of the tank body portion is inserted into the groove portion. The core plate has a rib protruding from the flat body portion outward of the tank and extending in a core plate-width direction in order to enhance stiffness in the core plate-width direction.

In a heat exchanger described in Patent Document 1, such rib overlaps an end part of tubes in a tube stacking direction over and is disposed such that a flat part coplanar with the a flat body portion is present on an inner side of a tank between the rib and a groove portion. This rib is formed by press forming.

Since the rib superior in stiffness overlaps the end part of the tubes, the stiffness with respect to the core plate-width direction in vicinity of the end part of tubes can be improved. On the other hand, the flat part provided between the rib and the groove portion is easy to be deformed. Thus, when a thermal stress is generated to make the core plate arch in a tube longitudinal direction, the thermal stress can be absorbed by deformation of the flat part. Consequently, compared with a heat exchanger in which a rib and a groove portion are in contact with each other without a flat part between the rib and the groove portion contrary to the heat exchanger described in the Patent Document 1, stress concentration on a tube base part that is a connection part between tubes and the core plate can be reduced when a temperature difference is generated between the tubes.

PRIOR ART DOCUMENT

Patent Document

Patent Document 1: JP 2008-32384 A

SUMMARY OF THE INVENTION

A heat exchanger is desired to be downsized, and for the realization of that, it is necessary to reduce a width of the core plate.

However, if the width of the core plate is reduced, the rib disposed similarly to the above-described Patent Document 1 may become difficult to be formed by press forming.

In consideration of the above-described points, it is an objective of the present disclosure to make it possible that a rib is formed by press forming such that the rib overlaps an end part of tubes in a tube stacking direction and is disposed to provide a flat part between the rib and the groove portion even when a width of a core plate is small.

According to an aspect of the present disclosure, a heat exchanger includes tubes and a tank communicating with the tubes. Each of the tubes has a flattened shape in cross-section, and the tubes are stacked in a direction approximately perpendicular to a tube width direction that is a longitudinal direction of the flattened shape. The tank communicates with the tubes. The tank includes a core plate into which the tubes are inserted, and a tank body portion fixed to the core plate to define an inner space of the tank together with the core plate. The core plate includes a flat body portion having a flat surface facing the inner space, and tube insertion holes into which the tubes are inserted, a groove portion provided on an outer edge of the flat body portion, an end part of the tank body portion being inserted into the groove portion, a rib having a shape protruding from the flat body portion outward of the tank and recessed from the flat body portion, the rib extending in the tube width direction, end parts of the tubes in the tube width direction being overlapped with the rib in a tube stacking direction, and a flat part having a flat surface coplanar with the flat surface of the flat body portion on an inner side of the tank between the rib and the groove portion in the tube width direction. The rib includes a rib bottom part recessed from the flat surface of the flat body portion to have a base line straight and parallel to the flat surface of the flat body portion in a sectional surface of the rib in the tube width direction, and a rib inclination part positioned between the rib bottom part and the flat part in the tube width direction and inclined to a line perpendicular to the flat surface of the flat part, the rib inclination part connecting the rib bottom part and the flat part. The rib inclination part overlaps, in the tube stacking direction, an end part of the tubes in the tube width direction.

According to another aspect of the present disclosure, a heat exchanger includes tubes and a tank communicating with the tubes. Each of the tubes has a flattened shape in cross-section, and the tubes are stacked in a direction approximately perpendicular to a tube width direction that is a longitudinal direction of the flattened shape. The tank communicates with the tubes. The tank includes a core plate into which the tubes are inserted, and a tank body portion fixed to the core plate to define an inner space of the tank together with the core plate. The core plate includes a flat body portion having a flat surface on an inner side of the tank, tube insertion holes into which the tubes are inserted being provided on the flat body portion, a groove portion provided on an outer circumferential edge part of the flat body portion, an end part of the tank body portion being inserted into the groove portion, a rib having a shape protruding from the flat body portion outward of the tank and recessed from the flat body portion, the rib extending in the tube width direction, end parts of the tubes in the tube width direction being overlapped with the rib in a tube stacking direction, and a flat part having a flat surface provided between an outermost part of the rib nearest to an outer side of the tank and the groove portion in the tube width direction, and disposed on an inner side of the tank. The rib includes a rib bottom part recessed from the flat surface of the flat body portion and positioned outermost of the tank within the rib, and a rib inclination part inclined to a line perpendicular to the flat surface of the flat part, the rib inclination part connecting the rib bottom part and the flat part. The outermost part of the rib is disposed on an outer side, in the tube width direction, of the end parts of the tubes in the tube width direction. An inner end part of the rib inclination part, positioned in a boundary part between the rib bottom part and the rib inclination part, is disposed on an inner side of the end parts of the tubes in the tube width direction.

Therefore, according to the above-described aspects of the present disclosure, a curved shape having its peak part in the flat part can be made into a gentle curved shape. Hence, even when a width of the core plate is small, the rib can be formed by press forming such that the rib overlaps the end part of the tubes in the tube stacking direction and is disposed to provide the flat part between the rib and the groove portion.

EMBODIMENTS FOR EXPLOITATION OF THE INVENTION

Figure 1:
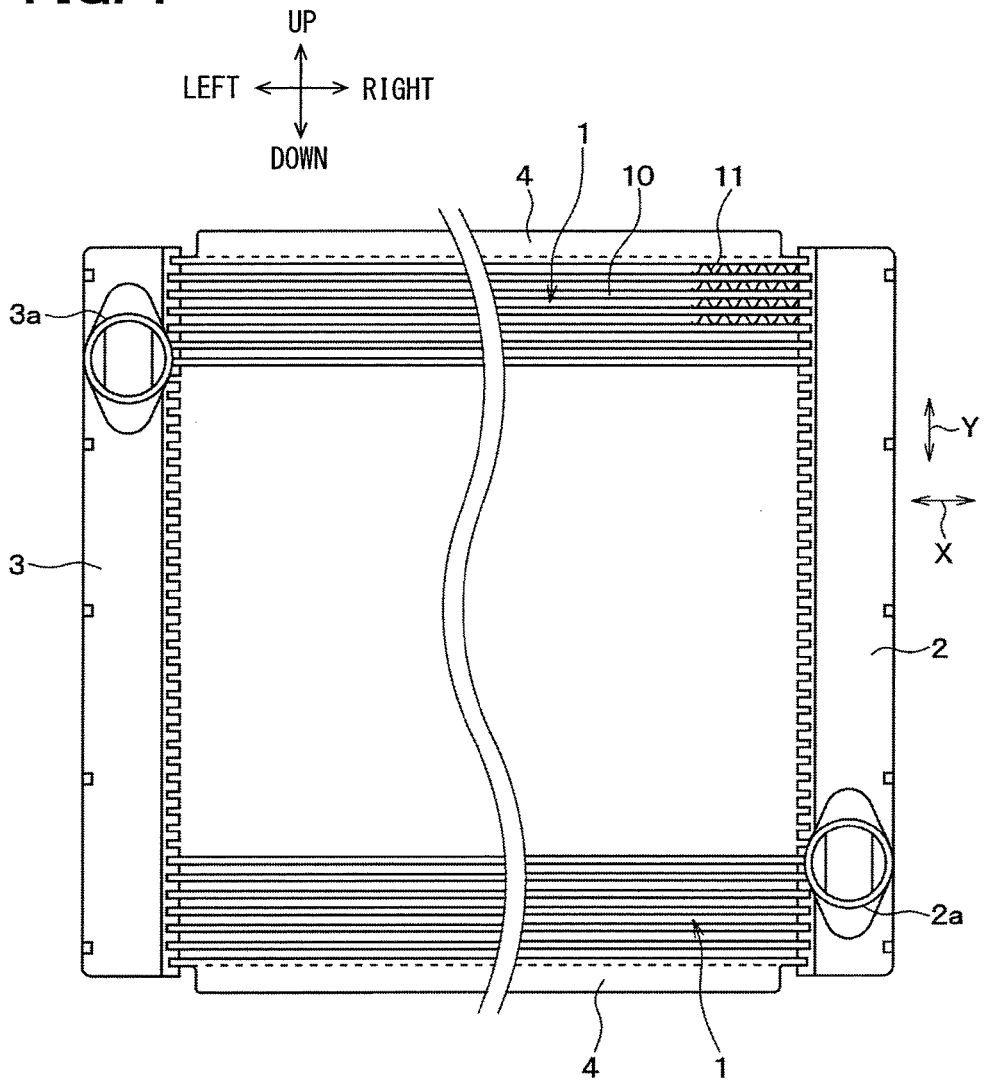
FIG. 1 is a schematic front view of a heat exchanger according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Figure 10:
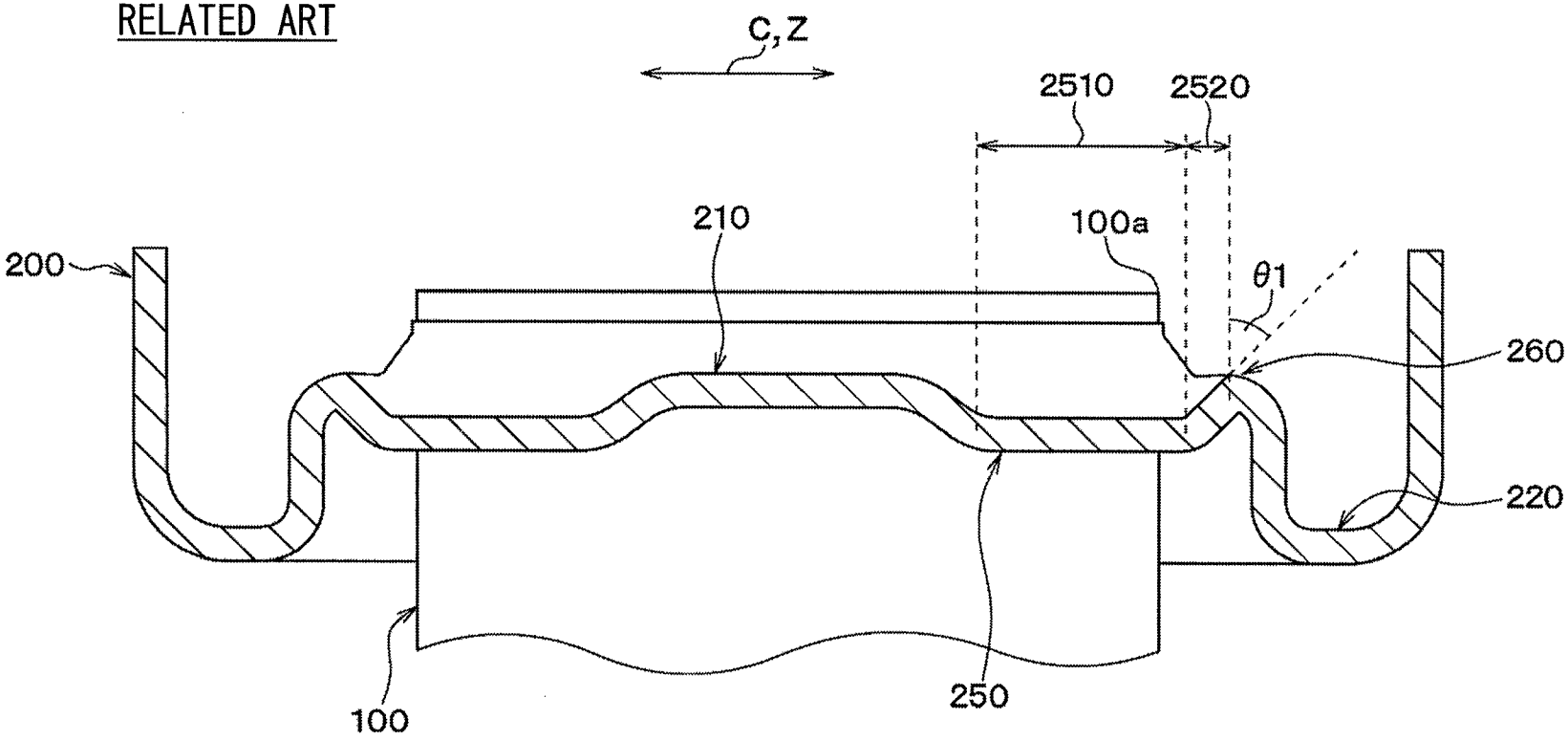
FIG. 10 RELATED ART
FIG. 10 is a sectional diagram of a core plate studied by the present inventors.

First, a core plate 200 of a tank of a heat exchanger studied by the inventors of the present application will be described with reference to FIG. 10. For producing an effect to reduce a stress concentration on a tube base part when a thermal stress is generated, it is thought to be necessary that an end part of a rib bottom part 2510 of a rib 250 is, as shown in FIG. 10, positioned on an outer side of an end part 100*a* of a tube 100 on the flat body portion 210 of the core plate 200, and the rib bottom part 2510 is positioned to overlap the end part 100*a* of the tube 100. In other words, it is thought to be necessary that a rib inclination part 2520 connecting the rib bottom part 2510 and the flat part 260 is positioned on the outer side of the end part 100*a* of the tube 100.

In this case, since the end part of the rib bottom part 2510 is necessary to be positioned on the outer side of the end part 100*a* of the tube 100, it is thought for reducing a width of the core plate 200 that a distance between the rib bottom part 2510 and the groove portion 220 is shortened. For this, as shown in FIG. 10, it is necessary that a length of the flat part 260 is shortened in a core plate-width direction (i.e., right-left direction in FIG. 10), and further, it is necessary that an inclination angle θ1 of the rib inclination part 2520 to a perpendicular line to the flat part 260 is reduced as much as possible.

However, when the rib 250 is disposed as shown in FIG. 10, and when the inclination angle θ1 of the rib inclination part 2520 is set lower than 45 degrees, a curved shape consisting of the rib bottom part 2510, the flat part 260 and a wall part of the groove portion 220 and having a peak part in the flat part 260 may become an extremely sharp curved shape, and press forming thereof may become difficult. According to results of further study by the present inventors, however, it is found that the stress concentration, which is generated on the tube base part when the thermal stress is produced, can be reduced if the rib inclination part is positioned to overlap the end part of the tube even when the end part of the rib bottom part is positioned on an inner side of the end part of the tube.

In this case, the curved shape having the peak part in the flat part can be made into a shallow curved shape as compared with a case where the end part of the rib bottom part is located on an outer side of the end part of the tube.

(First Embodiment)

In a present embodiment, a heat exchanger according to the present disclosure is applied to a radiator that cools a water-cooled internal combustion engine such as an engine for an automobile.

Figure 2:
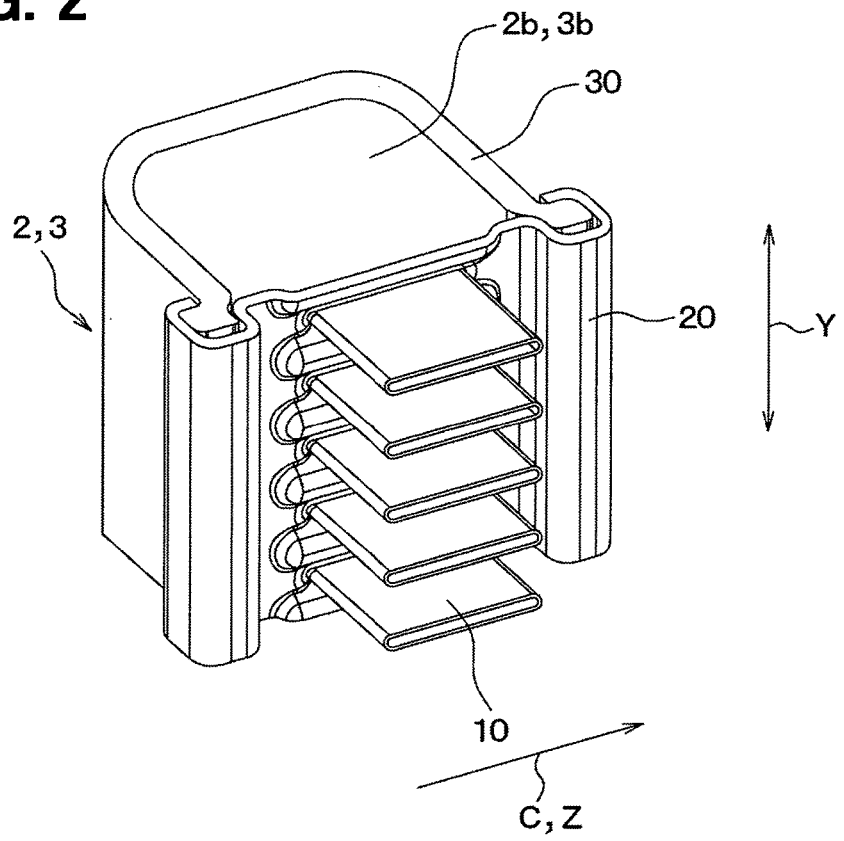
FIG. 2 is a schematic perspective view of a core plate of the heat exchanger according to the first embodiment.

As shown in FIGS. 1 and 2, the heat exchanger includes a core portion 1 having a rectangular parallelepiped shape. The core portion 1 includes multiple tubes 10 and multiple corrugated fins 11 which are alternately stacked in an up-down direction. The stacking direction of the tubes 10 and the corrugated fins 11 is referred to as a tube stacking direction Y, hereinafter.

The corrugated fins 11 are made of aluminum alloy and formed into corrugated shapes to accelerate heat exchange between air and cooling water.

Each tube 10 includes a passage through which the cooling water of the water-cooled internal combustion engine (not shown) mounted on a vehicle passes, and has a flattened shape in cross-section. The tube 10 is formed by bending a plate member made of aluminum alloy into a predetermined shape, and subsequently welding or brazing it.

In the present embodiment, as shown in FIG. 1, the heat exchanger is disposed such that a longitudinal direction (referred to as a tube longitudinal direction X, hereinafter) of the tube 10 is coincident with a horizontal direction, and the tube stacking direction Y is coincident with a gravitational direction. As shown in FIG. 2, a long axis direction of a cross-sectional shape of the tube 10 corresponds to a tube width direction Z, and the tube width direction Z is coincident with a flow direction C of air. A direction perpendicular to the tube width direction Z is coincident with the tube stacking direction Y. The tube width direction Z bisects both the tube stacking direction Y and the tube longitudinal direction X at right angles.

As shown in FIG. 1, disposed on both end part of the tube 10 in the tube longitudinal direction X are tanks 2 and 3 extending in a direction approximately perpendicular to the tube longitudinal direction X and having spaces therein. The end of the tube 10 in the tube longitudinal direction X is joined to the tanks 2 and 3 by being inserted into a tube insertion hole, and each of inner passages of the multiple tubes 10 communicates with the inner spaces of the tanks 2 and 3.

The tank 2 distributes and supplies high-temperature cooling water flowing out of the engine to the multiple tubes 10. This tank 2 has an inflow port pipe 2*a* connected to a cooling-water outlet side of the internal combustion engine via a hose (not shown).

The other tank 3 gathers the cooling water cooled via heat exchange with the air and discharges the cooling water to the internal combustion engine. The tank 3 has an outflow port pipe 3*a* connected to a cooling-water inlet side of the internal combustion engine via a hose.

Disposed on both end parts of the core portion 1 in the tube stacking direction Y are side plates 4 that reinforce the core portion 1. The side plates 4 are made of aluminum alloy and extend in a direction parallel to the tube longitudinal direction X, and both ends of each side plate 4 are connected to the tanks 2 and 3.

As show in FIG. 2, the tanks 2 and 3 each include a core plate 20 into which the multiple tubes 10 are inserted to be fixed, and a tank body portion 30 fixed to the core plate 20 and defining the inner space 2*b* or 3*b* of the tank 2 or 3 together with the core plate 20.

In the present embodiment, the core plate 20 is made of aluminum alloy, and the tank body portion 30 is made of resin such as grass fiber-reinforced nylon 66. The core plate 20 and the tank body portion 30 are fixed with a rubber packing (not shown) being interposed therebetween for securement of sealing performance. The fixation is performed by plastically deforming (crimping) protruding strips 224 of the core plate 20 shown in FIGS. 3A and 3B with the protruding strips 224 being pressed against the tank body portion 30.

Figure 3A:
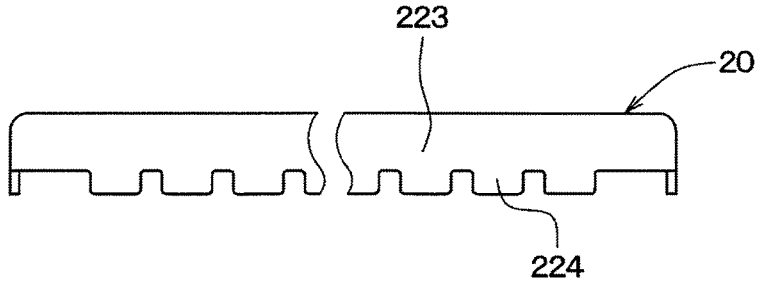
FIG. 3A is a schematic side view of the core plate of the heat exchanger according to the first embodiment.
Figure 3B:
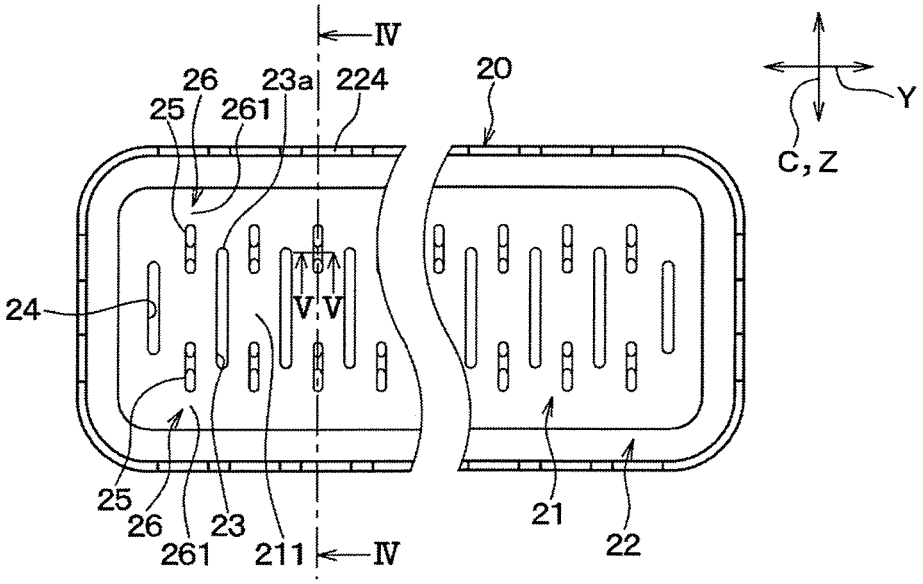
FIG. 3B is a schematic top view of the core plate viewed from an inner side of a tank of the heat exchanger according to the first embodiment.
Figure 4:
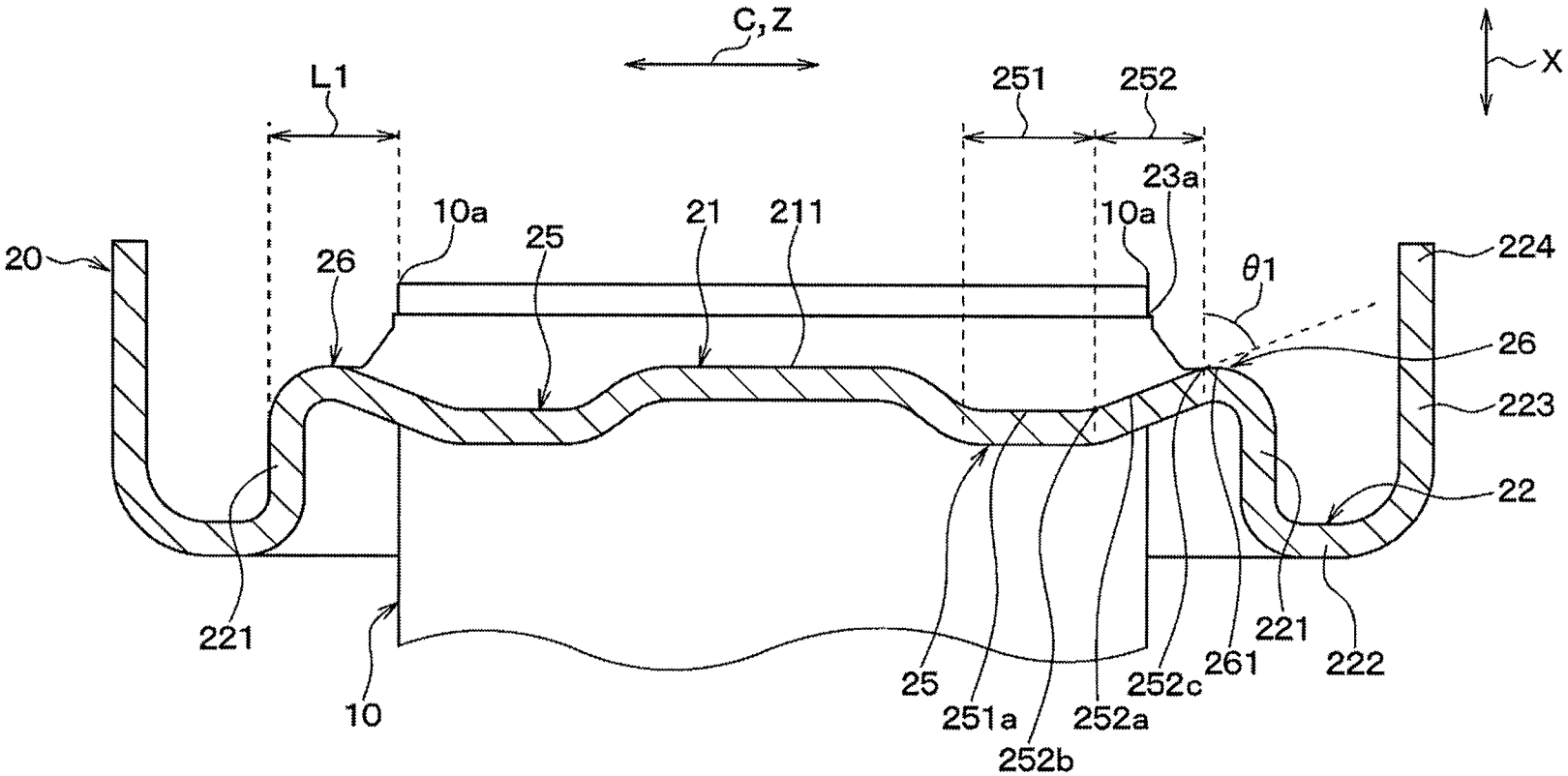
FIG. 4 is a sectional diagram taken along a line IV-IV of FIG. 3B.

As shown in FIGS. 3B and 4, the core plate 20 includes a flat body portion 21 having a flat surface 211 on an inner side of the tank, and a groove portion 22 provided on an entire outer edge of the flat body portion 21.

The groove portion 22 is a part into which an end part of the tank body portion 30 and the packing are inserted. The groove portion 22, as shown in FIG. 4, has a rectangular shape in cross-section and is made of three wall parts. In other words, the groove portion 22 comprises an inner wall part 221 that is bent to be approximately perpendicular to an outer circumferential part of the flat body portion 21 and extends therefrom in the tube longitudinal direction X, a bottom wall part 222 that is bent to be approximately perpendicular to the inner wall part 221 and extends therefrom perpendicularly to the tube longitudinal direction X, and an outer wall part 223 that is bent to be approximately perpendicular to the bottom wall part 222 and extends therefrom in the tube longitudinal direction X.

The inner wall part 221 is positioned on an inner side of the tank and extends approximately perpendicularly to the flat body portion 21. The outer wall part 223 is positioned on an outer side of the tank and extends approximately perpendicularly to the flat body portion 21. The bottom wall part 222 is positioned on a bottom of the groove portion 22 and communicates with both the inner wall part 221 and the outer wall part 223. As shown in FIGS. 3A, 3B and 4, the multiple protruding strips 224 are provided on an end part of the outer wall part 223.

As shown in FIG. 3B, provided on the flat body portion 21 in the tube stacking direction Y are multiple insertion holes 23 into which the multiple tubes 10 are inserted and brazed. A side-plate insertion hole 24, into which the side plate 4 is inserted and brazed, is provided on each of both end side of the flat body portion 21 in the tube stacking direction Y. The tube insertion holes 23 and the side-plate insertion holes 24 have shapes elongated in the tube width direction Z and formed by punching-out processing.

Further, the ribs 25 are formed in the flat body portion 21 by press forming between adjacent tube insertion holes 23 and between the tube insertion hole 23 and the side-plate insertion hole 24 so as to protrude from the flat body portion 21 outward of the tank and have elongated shapes extending in the tube width direction Z. When a position between adjacent tube insertion holes 23 on the flat body portion 21 is defined as an inter-insertion hole position, two ribs 25 are provided in every inter-insertion hole positions.

As shown in FIG. 3B, the ribs 25 are disposed such that end parts 23*a* of the tube insertion holes 23 in the tube width direction Z are overlapped with (positioned within) the ribs 25 when viewed from the tube stacking direction Y. In other words, as shown in FIG. 4, the ribs 25 are disposed such that end parts 10*a* of the tubes 10 in the tube width direction Z are overlapped with the ribs 25 in the tube stacking direction Y. That is, the ribs 25 are formed such that the end parts 10*a* of the tubes 10 in the tube width direction Z are overlapped with the ribs 25.

As shown in FIG. 3B, the ribs 25 are disposed such that their end parts in the tube width direction Z does not reach the groove portion 22, and such that a flat part 26 is present between the ribs 25 and the groove portion 22 in the tube width direction Z within the flat body portion 21. The flat part 26 is a part having a flat surface 261 coplanar with the flat surface 211 of the flat body portion 21 on an inner side of the tank. In other words, the flat surface 211 of the flat body portion 21 and the flat surface 261 of the flat part 26 are on the same surface. It can be said that the flat surface 261 of the flat part 26 and the flat surface 211 of the flat body portion 21 are remaining parts after forming the ribs 25.

The ribs 25 of the present embodiments will be describe in detail.

Figure 5:
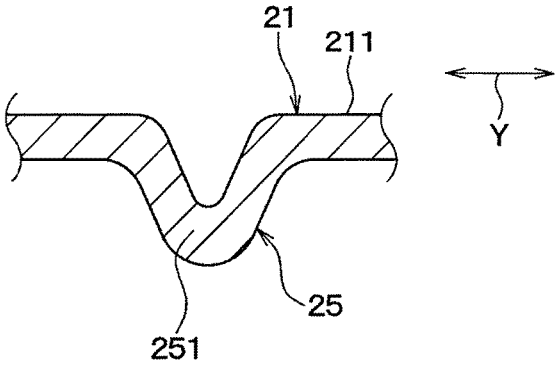
FIG. 5 is a sectional diagram taken along a line V-V of FIG. 3B.

As shown in FIGS. 4 and 5, the ribs 25 are formed by providing recesses on the flat surface 211 of the flat body portion 21.

In a sectional surface of each rib 25 taken along the tube width direction Z as shown in FIG. 4, the rib 25 has a shape including a rib bottom part 251 served as a base line 251*a* of the recess, and a rib inclination part 252 served as a line 252*a* (inclined line) other than the base line of the recess.

In the sectional surface of the rib 25, shown in FIG. 4, the base line 251*a* of the rib bottom part 251 is a line of a surface on the inner side of the tank, and is straight and parallel to the flat surface 211 of the flat body portion 21. The base line 251*a* is an outermost part in the tank within the rib 25.

The rib inclination part 252 is positioned between the rib bottom part 251 and the flat part 26. In the sectional surface of the rib 25, shown in FIG. 4, the line 252*a* of the rib inclination part 252 is a line of the surface on the inner side of the tank, and is straight and not parallel but inclined to a perpendicular line to the flat surface 261 of the flat part 26.

In the present embodiment, as shown in FIG. 4, not the rib bottom part 251, but the rib inclination part 252, is disposed such that the end part 10*a* of the tube 10 in the tube width direction Z is overlapped with the rib inclination part 252 in the tube stacking direction Y.

An inner end part 252*b* of the rib inclination part 252 is, in the sectional surface of the rib 25 shown in FIG. 4, positioned at a boundary part between the inclined line 252*a* of the rib inclination part 252 and the base line 251*a* of the rib bottom part 251. On the other hand, an outer end part 252*c* of the rib inclination part 252 is, in the sectional surface of the rib 25 shown in FIG. 4, positioned at a boundary part between the inclined line 252*a* of the rib inclination part 252 and the flat surface 261 of the flat part 26.

Figure 6:
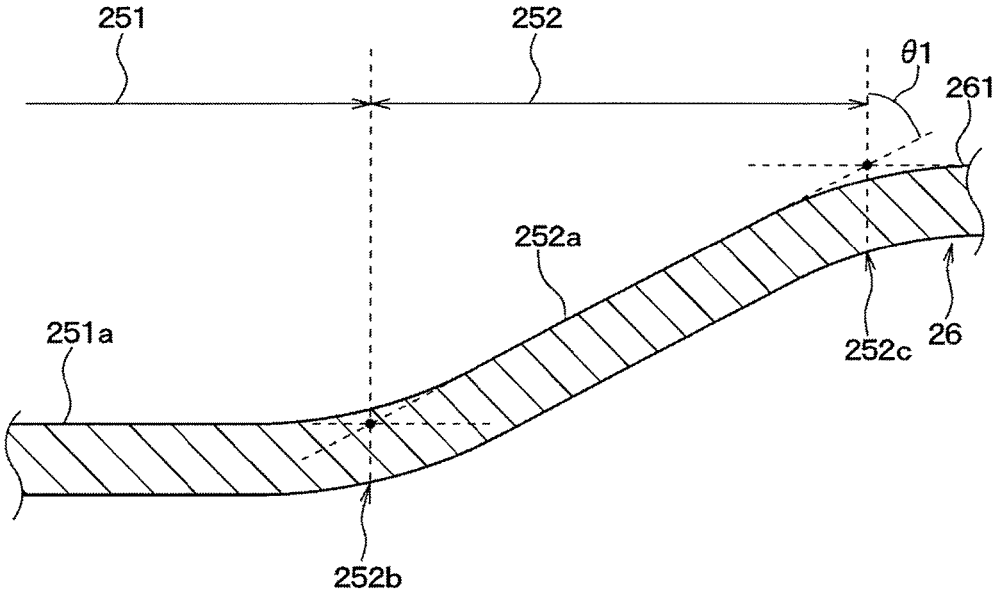
FIG. 6 is an enlarged diagram of a rib inclination part of FIG. 4.

As shown in FIG. 6, when the boundary part between the inclined line 252*a* of the rib inclination part 252 and the base line 251*a* of the rib bottom part 251 is curved mildly, the inner end part 252*b* of the rib inclination part 252 is positioned at a point at the intersection of an imaginary extended line, which is shown by a dashed line, of the inclined line 252*a* with an imaginary extended line, which is shown by a dashed line, of the base line 251*a*. Similarly, when the boundary part between the inclined line 252*a* of the rib inclination part 252 and the flat surface 261 is curved mildly, the outer end part 252*c* of the rib inclination part 252 is positioned at a point at the intersection of an imaginary extended line, which is shown by a dashed line, of the inclined line 252*a* with an imaginary extended line, which is shown by a dashed line, of a line of the flat part surface 261.

Therefore, in the present embodiment, the end part 10*a* of the tube 10 in the tube width direction Z is positioned between the inner end part 252*b* and the outer end part 252*c* of the rib inclination part 252. The outer end part 252*c* of the rib 25 is positioned on the outer side of the end part 10*a* of the tube 10 in the tube width direction Z. On the other hand, the inner end part 252*b* of the rib 25 is positioned on the inner side of the end part 10*a* of the tube 10 in the tube width direction Z.

Further, in the present embodiment, as shown in FIG. 4, an inclination angle θ1 of the rib inclination part 252 to the perpendicular line of the flat part 26 is from 45 to 80 degrees. In the example shown in FIG. 4, the inclination angle 01 is equal to 70 degrees. The inclination angle θ1 is, in the sectional surface shown in FIG. 4, an angle between the line 252*a* of the rib inclination part 252 and the perpendicular line to the flat surface 261 of the flat part 26.

In the present embodiment, a distance L1 between the end part 10*a* of the tube 10 in the tube width direction Z and an inner wall of the inner wall part 221 is from 4.0 to 6.3 mm. Thus, a core plate-width of the core plate 20 is reduced.

Next, effects of the present embodiment will be described.

As described above, in the present embodiment, the rib inclination part 252 is disposed such that the end part 10*a* of the tube 10 in the tube width direction Z is overlapped with the rib inclination part 252 in the tube stacking direction Y. Accordingly, the inclination angle 81 of the rib inclination part 252 can be set from 45 to 80 degrees, and the curved shape consisting of the inner wall part 221 of the groove portion 22, the flat part 26 and the rib inclination part 252 and having the peak part in the flat part 26 can be made into the gently curved shape.

Hence, according to the present embodiment, even when the core plate-width is small, the rib 25 can be formed by press forming such that the rib 25 overlaps the end part 10*a* of the tube 10 and is disposed to provide the flat part 26 between the rib 25 and the groove portion 22, in the tube stacking direction Y. In other words, by forming the rib 25 as in the present embodiment, the distance L1 between the end part 10*a* of the tube 10 in the tube width direction Z and the inner wall of the inner wall part 221 can be set from 4.0 to 6.3 mm, and thus the width of the core plate can be reduced.

Figure 7:
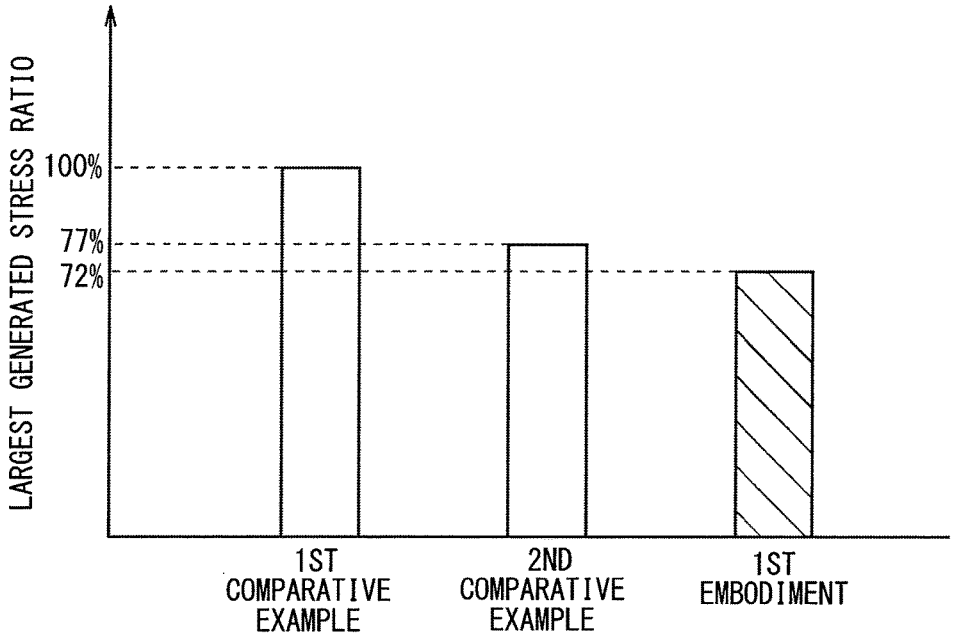
FIG. 7 is a diagram showing results of analyses of stress generated in a tube base part in the heat exchanger according to the first embodiment.

According to the present embodiment, as is clear from results of analyses of stress generated in a tube base part, shown in FIG. 7, a stress concentration on the tube base part due to thermal stress can be reduced as compared with a heat exchanger of a comparative example 2 where a rib is directly connected to the groove portion.

A comparative example 1 of FIG. 7 is a case where the rib is omitted in the heat exchanger of the present embodiment, and the comparative example 2 is a case where the end part of the rib 25 in the tube width direction Z extends to the groove portion 22 in the heat exchanger of the present embodiment. In FIG. 7, stress ratios are shown, and a largest generated stress of the comparative example 1 in a connection part between the tube and core plate (boundary part between the tube and a brazing member) when a temperature difference between the tubes is generated is defined as 100%.

(Second Embodiment)

Figure 8:
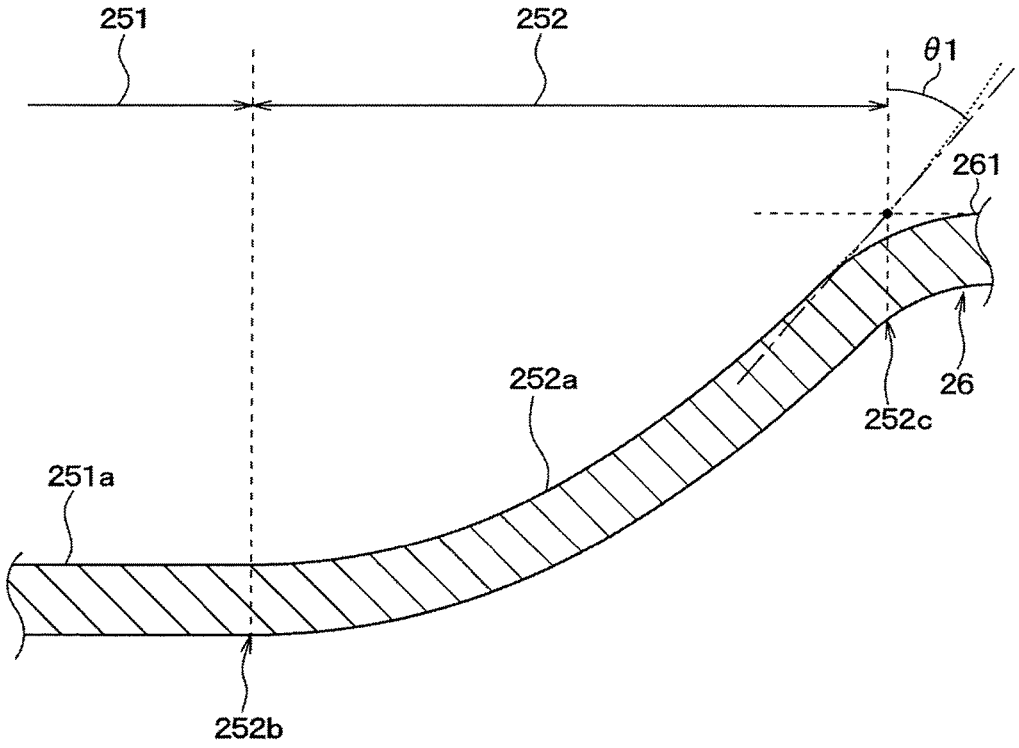
FIG. 8 is an enlarged diagram of a rib inclination part of a heat exchanger according to a second embodiment of the present disclosure.

In the first embodiment, in the sectional surface of the rib 25, shown in FIG. 4, the line 252*a* of the rib inclination part 252 is straight, but in a present embodiment, as shown in FIG. 8, a line 252*a* of a rib inclination part 252 has an ark shape. The other configurations are similar to the first embodiment. Also in this case, similar effects to the first embodiment can be obtained.

In this case, an inclination angle 81 of the rib inclination part 252 is an angle between the rib inclination part 252 and a perpendicular line to the flat part 26 in a boundary part between the rib inclination part 252 and the flat part 26.

More specifically, as shown in FIG. 8, defined as the inclination angle θ1 is an angle between a tangent line, shown by an alternate long and short dash line, of an arc line 252*a* and the perpendicular line, shown by a dashed line, of the a flat surface 261 at a boundary position 252*c* between the line 252*a* of the rib inclination part 252 and a line of the flat surface 261. When a boundary part between the rib inclination part 252 and the flat part 26 are curved in an opposite direction from the line 252*a* of the rib inclination part 252, the boundary position 252*c* between the rib inclination part 252 and the flat part 26 is positioned at a point at the intersection between an imaginary extended line, which is shown by a dashed line and extended from the line 252*a* of the rib inclination part 252 with keeping its arc shape, and an imaginary extended line, which is shown by a dashed line, of the line of a flat surface 261.

(Third Embodiment)

Figure 9:
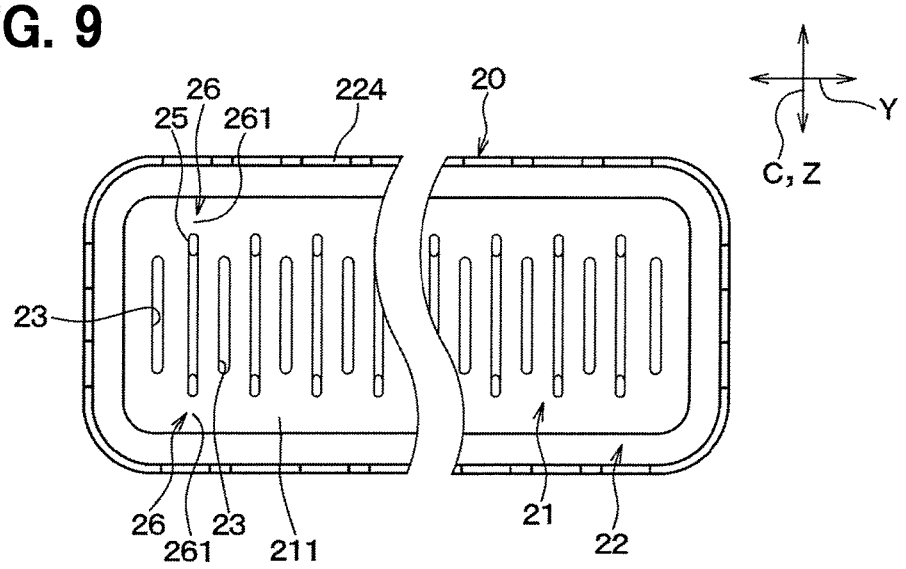
FIG. 9 is a top view of a core plate viewed from an inner side of a tank of a heat exchanger according to a third embodiment of the present disclosure.

In the first embodiment, two ribs 25 are provided in the tube width direction Z in the inter-tube insertion hole position of the flat body portion 21, but in a present embodiment, as shown in FIG. 9, these are connected into a single rib 25. In this case, the single rib 25 is disposed such that an end part of a tube insertion hole 23 in the tube width direction and the other end part of the tube insertion hole 23 in the tube width direction are overlapped with the single rib 25 in the tube stacking direction Y.

In the first embodiment, the side-plate insertion hole 24 is provided in the core plate 20, but in the present embodiment, as shown in FIG. 9, a tube insertion hole 23 is provided instead of the side-plate insertion hole 24.

Even when the first embodiment is modified as above, similar effects to the first embodiment can be obtained.

(Other Embodiments)

(1) In the first embodiment, two ribs 25 are provided in the tube width direction Z in every inter-insertion hole positions of the flat body portion 21, but one of the two ribs 25 may be omitted. In this case, inter-insertion hole positions, in which the ribs 25 are provided only on one end side of the tube insertion hole 23 in the tube width direction Z, and inter-insertion hole positions, in which the ribs 25 are provided only on the other end side of the tube insertion hole 23 in the tube width direction Z, may be disposed alternately in the tube stacking direction Y.

(2) In the above-described each embodiment, the ribs 25 are provided in every inter-insertion hole positions, but the ribs 25 may be provided only a part of the inter-insertion hole positions. More specifically, inter-insertion hole positions, in which two ribs 25 are provided, and inter-insertion hole positions, in which none of the ribs 25 are provided, may be disposed alternately in the tube stacking direction Y.

(3) In the above-described each embodiment, the flat surface 261 of the flat part 26 is coplanar with the flat surface 211 of the flat body portion 21, but the flat part 26 only has to be provided at least on an inner side of the rib bottom part 251 in the tank.

(4) In the above-described each embodiment, an example in which the present disclosure is applied to the radiator is described, but the present disclosure can be applied to a heat exchanger for other usages such as a heater core for air heating in an automobile.

(5) The above-describe each embodiment may be combined within a feasible range.

What is claimed is:

1. A heat exchanger comprising:

tubes each of which has a flattened shape in cross-section, the tubes being stacked in a direction approximately perpendicular to a tube width direction that is a longitudinal direction of the flattened shape, and a tank communicating with the tubes, wherein the tank includes:

a core plate into which the tubes are inserted; and a tank body portion fixed to the core plate to define an inner space of the tank together with the core plate, the core plate includes:

a flat body portion having a flat surface facing the inner space, and tube insertion holes into which the tubes are inserted;

a groove portion provided on an outer edge of the flat body portion, an end part of the tank body portion being inserted into the groove portion;

a rib having a shape protruding outward of the tank, from the flat body portion, at a position other than the tube insertion holes, the rib being recessed from the flat surface of the flat body portion, the rib extending in the tube width direction, end parts of the tubes in the tube width direction being overlapped with the rib in a tube stacking direction;

a flat part having a flat surface coplanar with the flat surface of the flat body portion on an inner side of the tank between the rib and the groove portion in the tube width direction, and a sleeve portion obliquely extending from the flat surface of the flat body at a connection point to the end parts of the tubes, the connection point is within a range between the rib and the groove portion in the tube width direction, the rib includes a rib bottom part recessed from the flat surface of the flat body portion to have a base line straight and parallel to the flat surface of the flat body portion in a sectional surface of the rib in the tube width direction, and a rib inclination part positioned between the rib bottom part and the flat part in the tube width direction and inclined to a line perpendicular to the flat surface of the flat part, the rib inclination part connecting the rib bottom part and the flat part, and the rib inclination part overlaps, in the tube stacking direction, an end part of the tubes in the tube width direction.

2. The heat exchanger according to claim 1, wherein an angle of the rib inclination part to the line perpendicular to the flat part in a boundary part between the rib inclination part and the flat part is from 45 to 80 degrees.

3. The heat exchanger according to claim 2, wherein the angle is equal to 70 degrees.

4. The heat exchanger according to claim 1, wherein the groove portion includes an inner wall part extending approximately perpendicularly to the flat body portion of the core plate and positioned on the inner side of the tank, an outer wall part extending approximately perpendicularly to the flat body portion and positioned on an outer side of the tank, and a bottom wall part connecting to both the inner wall part and the outer wall part and positioned on a bottom of the groove portion, and a distance between an end part of the tubes in the tube width direction and an inner wall of the inner wall part is from 4.0 to 6.3 mm.

5. The heat exchanger according to claim 1, wherein the sleeve portion is configured to guide the tubes into the tube insertion holes.

6. A heat exchanger comprising:

tubes each of which has a flattened shape in cross-section, the tubes being stacked in a direction approximately perpendicular to a tube width direction that is a longitudinal direction of the flattened shape, and a tank communicating with the tubes, wherein the tank includes:

a core plate into which the tubes are inserted; and a tank body portion fixed to the core plate to define an inner space of the tank together with the core plate, the core plate includes:

a flat body portion having a flat surface on an inner side of the tank, tube insertion holes into which the tubes are inserted being provided on the flat body portion;

a groove portion provided on an outer circumferential edge part of the flat body portion, an end part of the tank body portion being inserted into the groove portion;

a rib having a shape protruding outward of the tank, from the flat body portion, at a position other than the tube insertion holes, the rib being recessed from the flat surface of the flat body portion, the rib extending in the tube width direction, end parts of the tubes in the tube width direction being overlapped with the rib in a tube stacking direction;

a flat part having a flat surface provided between an outermost part of the rib nearest to an outer side of the tank and the groove portion in the tube width direction, and disposed on an inner side of the tank, and a sleeve portion obliquely extending from the flat surface of the flat body at a connection point to the end parts of the tubes, the connection point is within a range between the rib and the groove portion in the tube width direction, the rib includes a rib bottom part recessed from the flat surface of the flat body portion and positioned outermost of the tank within the rib, and a rib inclination part inclined to a line perpendicular to the flat surface of the flat part, the rib inclination part connecting the rib bottom part and the flat part, the outermost part of the rib is disposed on an outer side, in the tube width direction, of the end parts of the tubes in the tube width direction, and an inner end part of the rib inclination part, positioned in a boundary part between the rib bottom part and the rib inclination part, is disposed on an inner side of the end parts of the tubes in the tube width direction.

7. The heat exchanger according to claim 6, wherein an angle of the rib inclination part to the line perpendicular to the flat part in a boundary part between the rib inclination part and the flat part is from 45 to 80 degrees.

8. The heat exchanger according to claim 7, wherein the angle is equal to 70 degrees.

9. The heat exchanger according to claim 6, wherein the sleeve portion is configured to guide the tubes into the tube insertion holes.

10. A heat exchanger comprising:

tubes each of which has a flattened shape in cross-section, the tubes being stacked in a direction approximately perpendicular to a tube width direction that is a longitudinal direction of the flattened shape, and a tank communicating with the tubes, wherein the tank includes:

a core plate into which the tubes are inserted; and a tank body portion fixed to the core plate to define an inner space of the tank together with the core plate, the core plate includes:

a flat body portion having a flat surface facing the inner space, and tube insertion holes into which the tubes are inserted;

a groove portion provided on an outer edge of the flat body portion, an end part of the tank body portion being inserted into the groove portion;

a rib having a shape protruding outward of the tank, from the flat body portion, at a position other than the tube insertion holes, the rib being recessed from the flat surface of the flat body portion, the rib extending in the tube width direction, end parts of the tubes in the tube width direction being overlapped with the rib in a tube stacking direction;

a flat part having a flat surface coplanar with the flat surface of the flat body portion on an inner side of the tank between the rib and the groove portion in the tube width direction, a sleeve portion obliquely extending from the flat surface of the flat part to the end parts of the tubes, the rib includes a rib bottom part recessed from the flat surface of the flat body portion to have a base line straight and parallel to the flat surface of the flat body portion in a sectional surface of the rib in the tube width direction, and a rib inclination part positioned between the rib bottom part and the flat part in the tube width direction and inclined to a line perpendicular to the flat surface of the flat part, the rib inclination part connecting the rib bottom part and the flat part, the rib inclination part overlaps, in the tube stacking direction, an end part of the tubes in the tube width direction, the groove portion includes an inner wall part extending approximately perpendicularly to the flat body portion of the core plate and positioned on the inner side of the tank, an outer wall part extending approximately perpendicularly to the flat body portion and positioned on an outer side of the tank, and a bottom wall part connecting to both the inner wall part and the outer wall part and positioned on a bottom of the groove portion, and a distance between an end part of the tubes in the tube width direction and an inner wall of the inner wall part is from 4.0 to 6.3 mm.

11. The heat exchanger according to claim 10, wherein an angle of the rib inclination part to the line perpendicular to the flat part in a boundary part between the rib inclination part and the flat part is from 45 to 80 degrees.

12. The heat exchanger according to claim 11, wherein the angle is equal to 70 degrees.

13. The heat exchanger according to claim 10, wherein the sleeve portion is configured to guide the tubes into the tube insertion holes.

14. A heat exchanger comprising:

tubes each of which has a flattened shape in cross-section, the tubes being stacked in a direction approximately perpendicular to a tube width direction that is a longitudinal direction of the flattened shape, and a tank communicating with the tubes, wherein the tank includes:

a core plate into which the tubes are inserted; and a tank body portion fixed to the core plate to define an inner space of the tank together with the core plate, the core plate includes:

a flat body portion having a flat surface on an inner side of the tank, tube insertion holes into which the tubes are inserted being provided on the flat body portion;

a groove portion provided on an outer circumferential edge part of the flat body portion, an end part of the tank body portion being inserted into the groove portion;

a rib having a shape protruding outward of the tank, from the flat body portion, at a position other than the tube insertion holes, the rib being recessed from the flat surface of the flat body portion, the rib extending in the tube width direction, end parts of the tubes in the tube width direction being overlapped with the rib in a tube stacking direction;

a flat part having a flat surface provided between an outermost part of the rib nearest to an outer side of the tank and the groove portion in the tube width direction, and disposed on an inner side of the tank, a sleeve portion obliquely extending from the flat surface of the flat part to the end parts of the tubes, the rib includes a rib bottom part recessed from the flat surface of the flat body portion and positioned outermost of the tank within the rib, and a rib inclination part inclined to a line perpendicular to the flat surface of the flat part, the rib inclination part connecting the rib bottom part and the flat part, the outermost part of the rib is disposed on an outer side, in the tube width direction, of the end parts of the tubes in the tube width direction, an inner end part of the rib inclination part, positioned in a boundary part between the rib bottom part and the rib inclination part, is disposed on an inner side of the end parts of the tubes in the tube width direction, and an angle of the rib inclination part to the line perpendicular to the flat part in a boundary part between the rib inclination part and the flat part is from 45 to 80 degrees.

15. The heat exchanger according to claim 14, wherein the angle is equal to 70 degrees.

16. The heat exchanger according to claim 14, wherein the sleeve portion is configured to guide the tubes into the tube insertion holes.

* * * * *